US011827258B2

(12) United States Patent
Sun et al.

(10) Patent No.: US 11,827,258 B2
(45) Date of Patent: Nov. 28, 2023

(54) TRAIN DRIVER ASSISTANCE METHOD, SYSTEM, DEVICE, AND COMPUTER-READABLE STORAGE MEDIUM

(71) Applicant: Southwest Jiaotong University, Chengdu (CN)

(72) Inventors: Pengfei Sun, Chengdu (CN); Xiaoyun Feng, Chengdu (CN); Qingyuan Wang, Chengdu (CN); Junshu Cheng, Chengdu (CN); Wensheng Song, Chengdu (CN)

(73) Assignee: Southwest Jiaotong University, Chengdu (CN)

( * ) Notice: Subject to any disclaimer, the term of this patent is extended or adjusted under 35 U.S.C. 154(b) by 0 days.

(21) Appl. No.: 17/965,795

(22) Filed: Oct. 14, 2022

(65) Prior Publication Data

US 2023/0117087 A1 Apr. 20, 2023

(30) Foreign Application Priority Data

Oct. 18, 2021 (CN) ..... 202111206859.4

(51) Int. Cl.
*B61L 27/04* (2006.01)

(52) U.S. Cl.
CPC ..... *B61L 27/04* (2013.01)

(58) Field of Classification Search
CPC ..... B61L 27/20; B61L 27/04; B61L 27/16; B61L 3/008; B61L 3/006; B61L 5/0081; B61L 23/14; B61L 15/0081
USPC ..... 701/1, 19, 20, 415
See application file for complete search history.

(56) References Cited

FOREIGN PATENT DOCUMENTS

| | | | |
|---|---|---|---|
| CN | 101274636 | * 10/2008 | ..... B61K 9/08 |
| CN | 107390099 | * 11/2017 | ..... G01R 31/12 |
| CN | 112448592 | * 3/2021 | ..... H02M 1/36 |
| CN | 113635943 | * 11/2021 | ..... B61L 23/14 |

* cited by examiner

*Primary Examiner* — Hai H Huynh
(74) *Attorney, Agent, or Firm* — Bayramoglu Law Offices LLC

(57) ABSTRACT

A train driver assistance method includes: acquiring basic data of a train under a complex and severe condition; determining whether a traction power system is normal according to the basic data; if so, acquiring an energy-efficient optimized speed profile of the train in a normal state according to the basic data of the train in the current state; and if not, acquiring an energy-efficient optimized speed profile of the train in an abnormal state according to the basic data of the train in the current state. In this way, the method can acquire the energy-efficient optimized speed profile of the train in its current state. The comprehensive electric train driver assistance method can enable the train to adapt to the complex and severe environment and realize the energy-efficient operation of the train and self-rescue of the train.

15 Claims, 4 Drawing Sheets

TRAIN DRIVER ASSISTANCE METHOD, SYSTEM, DEVICE, AND COMPUTER-READABLE STORAGE MEDIUM

CROSS REFERENCE TO THE RELATED APPLICATIONS

This application is based upon and claims priority to Chinese Patent Application No. 202111206859.4, filed on Oct. 18, 2021, the entire contents of which are incorporated herein by reference.

TECHNICAL FIELD

The present disclosure relates to the field of electric train driver assistance and, in particular, to a train driver assistance method, system, device, and computer-readable storage medium.

BACKGROUND

In recent years, China's large-scale high-speed railway network has gradually expanded to its western region and some mountainous areas. Due to the harsh environment in the western region and mountainous areas, high-speed railway lines operate under extremely complex conditions, and many lines face the problems of long operating mileage, long routing, large altitude changes, and variable and harsh climate. To solve the problems that the normal operation of electric railways under complex and severe operating conditions is difficult and the power supply conditions are easily affected by extreme bad weather, a driver assistance system is urgently needed.

The driver assistance system (DAS) aims at safety, punctuality, and high energy efficiency, and is based on external factors, such as line facilities, line conditions, timetable, traction power supply, and internal parameters, such as train traction/braking characteristics and train weight and length. The DAS can provide a speed profile for the driver or an automatic train control (ATC) system to control the high-speed train to achieve punctuality, reduce traction energy consumption, and reduce the frequency of working condition switching.

When the traction power system fails due to various reasons, the urgent assistant system (UAS) is activated to control the train. The UAS operates based on line gradients, two-way arrivals, the train traction/braking characteristics in emergencies, the energy consumption of auxiliary systems, and the capacity and power of the on-board energy storage device. It can generate optimized speed profiles of the train in normal states, and realize rapid self-rescue of the train in the case of a traction power system failure, ensuring the train's operational efficiency and personnel's safety in the event of a train failure.

SUMMARY

Given the above deficiencies in the prior art, the present disclosure provides a train driver assistance method, system, device, and a computer-readable storage medium. The present disclosure provides a comprehensive electric train driver assistance system. It provides an optimized speed profile of the train under the condition of normal power supply and a safe operation strategy and speed profile of the train under the condition of abnormal power supply to ensure train cruising efficiency and personnel safety in case of a train failure.

To achieve the above objective, the present disclosure adopts the following technical solutions:

In the first aspect, a train driver assistance method includes the following steps:

S1: acquiring basic data of a train under a complex and severe condition;

S2: determining whether a traction power system is normal according to the basic data; if yes, proceeding to step S3; and if not, proceeding to step S4;

S3: acquiring an energy-efficient optimized speed profile of the train in a normal state according to the basic data of the train in a current state;

S4: acquiring an energy-efficient optimized speed profile of the train in an abnormal state according to the basic data of the train in the current state.

Further, step S2 may specifically include:

determining whether the traction power system is normal according to a catenary voltage in running state information of the train; if the catenary voltage is non-zero, determining that the traction power system is in a normal state and proceeding to step S3; and if the catenary voltage is zero, determining that the traction power system is in an abnormal state and proceeding to step S4.

Further, step S3 may specifically include:

S31: giving a train running time;

S32: calculating a min-time speed profile and a minimum running time according to the basic data of the train in the current state, where the minimum running time is expressed as:

$$T_{min} = \sum_{i=0}^{n} \Delta t_i$$

where $T_{min}$ denotes the minimum running time, n denotes the total number of steps for calculation, and $\Delta t_i$ denotes the running time of the i-th segment;

S33: determining whether there is a surplus time between the minimum running time and the given running time; if not, taking the minimum running speed profile as the energy-efficient optimized speed profile of the train in the normal state; and if so, proceeding to step S34;

S34: performing energy-efficient optimization according to data of the min-time speed profile and the surplus time to acquire an optimized speed profile as the energy-efficient optimized speed profile of the train in the normal state, where an objective function of the optimized speed profile is:

$$\min J = \int_{x_0}^{x_f} F_t(v) - \alpha F_d(v)\,dx$$

where min J denotes a value of the objective function for minimum energy consumption of the train, $x_0$ and $x_f$ denote a starting position and an ending position of a running section, $F_t(v)$ denotes a traction force on the train; $F_d(v)$ denotes an electric braking force on the train, and a denotes a regenerative braking energy utilization of the train.

Further, step S4 may specifically include:

S41: switching the power source of the train in the current state and acquiring a minimum energy consumption and a speed profile of the train running forward in the current state, where the minimum energy consumption of the train running forward is expressed as:

$$E_F=E_T+E_{AUX}$$

where $E_F$ denotes the minimum energy consumption of the train running forward, $E_T$ denotes the traction energy consumption of the train running forward, and $E_{AUX}$ denotes an auxiliary energy consumption of the train running forward;

S42: comparing the minimum energy consumption of the train running forward with the on-board energy storage of the train in the current state; if the on-board energy storage is greater than the minimum energy consumption of the train running forward, taking the speed profile of the train running forward in the current state as the energy-efficient optimized speed profile of the train in the current state; and if not, proceeding to step S43;

S43: parking the train with a maximum braking force in the current state, acquiring parking information of the train, and proceeding to step S44;

S44: calculating minimum energy consumption and a speed profile of the train running backward according to the acquired train parking information, where the minimum energy consumption of the train running backward is expressed as:

$$E_B=E_T^*+E_{AUX}^*$$

where $E_B$ denotes the minimum energy consumption of the train running backward, $E_T^*$ denotes the traction energy consumption of the train running backward, and $E_{AUX}^*$ denotes an auxiliary energy consumption of the train running backward;

S45: comparing the minimum energy consumption of the train running backward with the on-board energy storage of the train in the current state; if the on-board energy storage of the train in the current state is greater than the minimum energy consumption of the train running backward, taking the speed profile of the train running backward in the current state as the energy-efficient optimized speed profile of the train in the current state; and if not, proceeding to step S46;

S46: determining that the train is unable to arrive in the current state and feeding back the information that the train is unable to arrive to a station executive.

Further, in step S41, an objective function of the speed profile of the train running forward in the current state may be expressed as:

$$\min J'=\int_{x_0}^{x_f}F_t(v)'-\alpha F_d(v)'dx+TP_{AUX}'$$

where min J denotes a value of the objective function for the minimum energy consumption of the train running forward; $x_0$ and $x_f$ denote a starting position and an ending position of a running section, respectively; $F_t(v)'$ denotes a traction force on the train running forward; $F_d(v)'$ denotes an electric braking force on the train running forward; $F_t(v)'$ denotes a regenerative braking energy utilization of the train; a denotes a regenerative braking energy utilization of the train; T denotes a total duration of the train in emergency running; and $P_{AUX}'$ denotes an auxiliary power of the train running forward.

Further, in step S44, an objective function of the speed profile of the train running backward in the current state may be expressed as:

$$\min J^*=\int_{x_0}^{x_f}F_t(v)-\alpha F_d(v)dx+TP_{AUX}$$

where min J* denotes a value of the objective function for the minimum energy consumption of the train running backward; $x_0$ and $x_f$ denote a starting position and an ending position of a running section, respectively; $F_t(v)^*$ denotes a traction force on the train running backward; $F_d(v)^*$ denotes an electric braking force on the train running backward; α denotes a regenerative braking energy utilization of the train; T denotes a total duration of the train in emergency running; and $P_{AUX}^*$ denotes an auxiliary power of the train running forward.

In a second aspect, a train driver assistance system includes:

a data acquisition module configured to acquire basic data of a train under a complex and severe condition;

a determination module configured to determine whether a traction power system is normal according to the basic data;

a normal-state optimized speed profile acquisition module configured to acquire an energy-efficient optimized speed profile of the train in a normal state according to the basic data of the train in a current state;

an abnormal-state optimized speed profile acquisition module configured to acquire an energy-efficient optimized speed profile of the train in an abnormal state according to the basic data of the train in the current state; and an energy-efficient optimized speed profile output module configured to output the acquired energy-efficient optimized speed profile.

In a third aspect, a train driver assistance system (DAS) device includes:

a memory configured to store a computer program; and a processor configured to execute the computer program to implement the disclosed train driver assistance method.

In a fourth aspect, a computer-readable storage medium stores a computer program, where the computer program is executed by a processor to implement the above train driver assistance method.

The present disclosure has the following beneficial effects.

The method of the present disclosure includes: acquiring basic data of a train under a complex and severe condition; determining whether a traction power system is normal according to the basic data; if so, acquiring an energy-efficient optimized speed profile of the train in a normal state according to the basic data of the train in the current state to enable the train to arrive at a scheduled station in a safe, smooth, punctual, energy-efficient and efficient manner; and if not, acquiring an energy-efficient optimized speed profile of the train in an abnormal state according to the basic data of the train in the current state to enable the train to arrive at the nearest station safely. The present disclosure provides a comprehensive electric train driver assistance method and system, which enable the train to adapt to the complex and severe line environment and realize the energy-efficient operation of the train under the condition of normal power supply and self-rescue of the train under the condition of abnormal power supply. Therefore, the present disclosure can ensure the train's operational efficiency and personnel's safety in the event of a train failure.

DETAILED DESCRIPTION OF THE EMBODIMENTS

The specific implementations of the present disclosure are described below to facilitate those skilled in the art to understand the present disclosure, but it should be clear that the present disclosure is not limited to the scope of the specific implementations. Various obvious changes made by those of ordinary skill in the art within the spirit and scope of the present disclosure defined by the appended claims should fall within the protection scope of the present disclosure.

Figure 1:
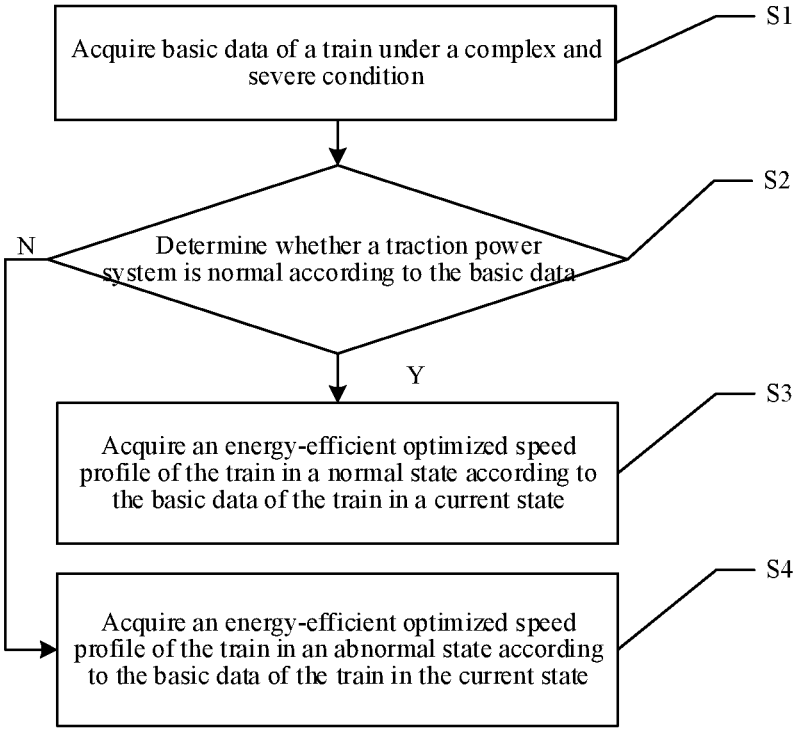
FIG. 1 is a flowchart of a train driver assistance method according to the present disclosure.

As shown in FIG. 1, a train driver assistance method includes steps S1 to S4:

S1: Acquire basic data of a train under a complex and severe condition.

In practical applications, it is necessary to check whether each working module of the train is normal when the train starts and then read the data required for optimization. These data include basic data of the train under complex and severe conditions, such as line facilities, line speed restrictions, line gradients, line curves, timetables, train traction/braking characteristics, on-board energy storage battery capacity, on-board energy storage battery power, auxiliary electrical power, train weight, and train length. These data also include train running lines received in real-time and signals sent to the train, such as signals, catenary state, and real-time train running state.

S2: Determine whether a traction power system is normal according to the basic data: If yes, proceed to step S3, and if not, proceed to step S4.

In practical applications, it is determined whether the traction power system is normal according to the signals received by the train as part of the basic data. If the traction power system is normal, the train enters a driver assistance mode. If the traction power system is abnormal, the train enters an urgent assistant mode.

In this embodiment, step S2 specifically includes determining whether the traction power system is normal according to a catenary voltage in the running state information of the train.

If the catenary voltage is non-zero, the traction power system is determined to be in a normal state, and the system proceeds to step S3. If the catenary voltage is zero, the traction power system is determined to be in an abnormal state, and the system proceeds to step S4.

S3: Acquire an energy-efficient optimized speed profile of the train in a normal state according to the basic data of the train in a current state.

Figure 2:
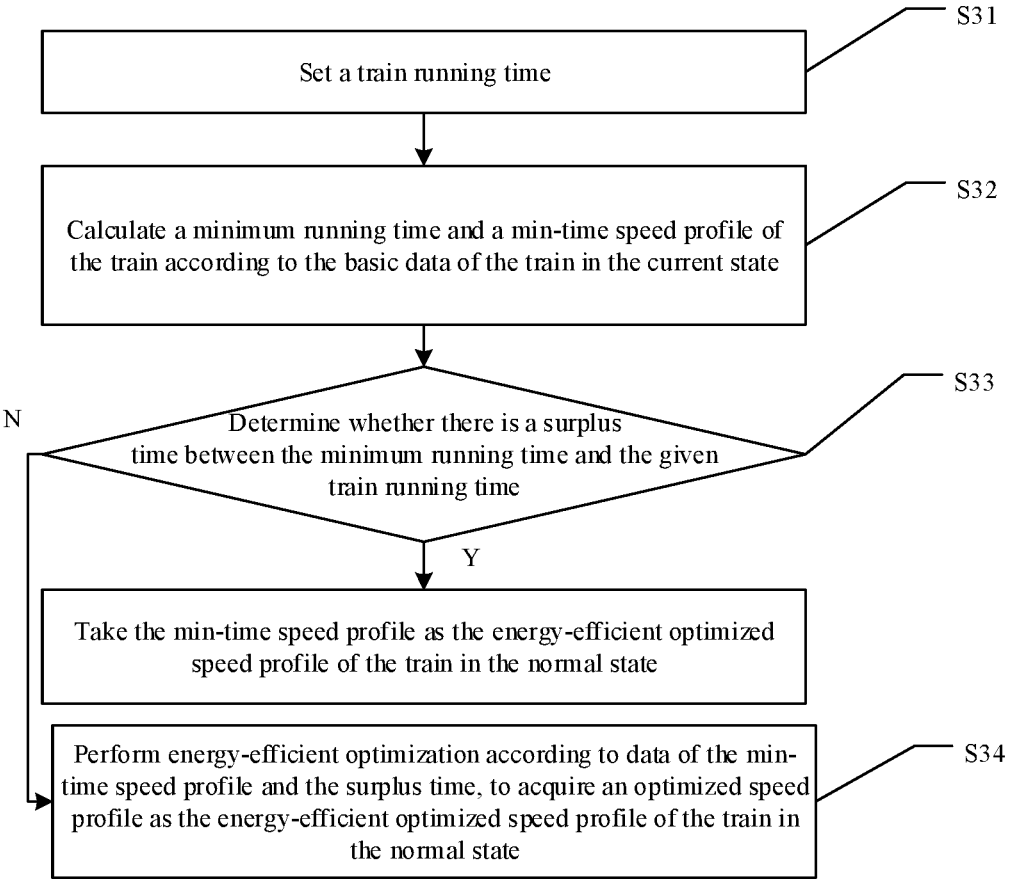
FIG. 2 is a flowchart of step S3 of the train driver assistance method according to the present disclosure.

As shown in FIG. 2, in this embodiment, step S3 specifically includes:

S31: Give a train running time.

S32: Calculate the minimum running time and the min-time speed profile of the train according to the basic data of the train in the current state, where the minimum running time is expressed as:

$$T_{min} = \sum_{i=0}^{n} \Delta t_i$$

where $T_{min}$ denotes the minimum running time, n denotes the total number of steps for calculation, and $\Delta t_i$ denotes the running time of an i-th segment;

In practical applications, the present disclosure does not limit the method for acquiring the min-time speed profile, and the embodiment of the present disclosure adopts Pontryagin's maximum principle (PMP).

First, according to the basic data of the train in the current state, outside the restricted segment of the line, full traction is adopted, and the speed profile under the maximum traction force is as follows:

$$F_k(v) = \begin{cases} av + b & v \le v_1 \\ c/v & v_1 < v \le v_{max} \end{cases}$$

where $F_k(v)$ denotes the maximum traction force related to speed, a, b, c are constants, v denotes the speed of the train in the current state, $v_1$ denotes a first preset speed threshold, and $v_{max}$ denotes a preset maximum speed threshold.

Second, according to the basic data of the train in the current state, in the restricted segment of the line, the speed limit is a constant speed, and the speed profile under constant speed operation is acquired.

Finally, according to the basic data of the train in the current state, the allowable maximum braking force is adopted to generate a braking speed profile, and the min-time speed profile can be obtained.

Figure 3:
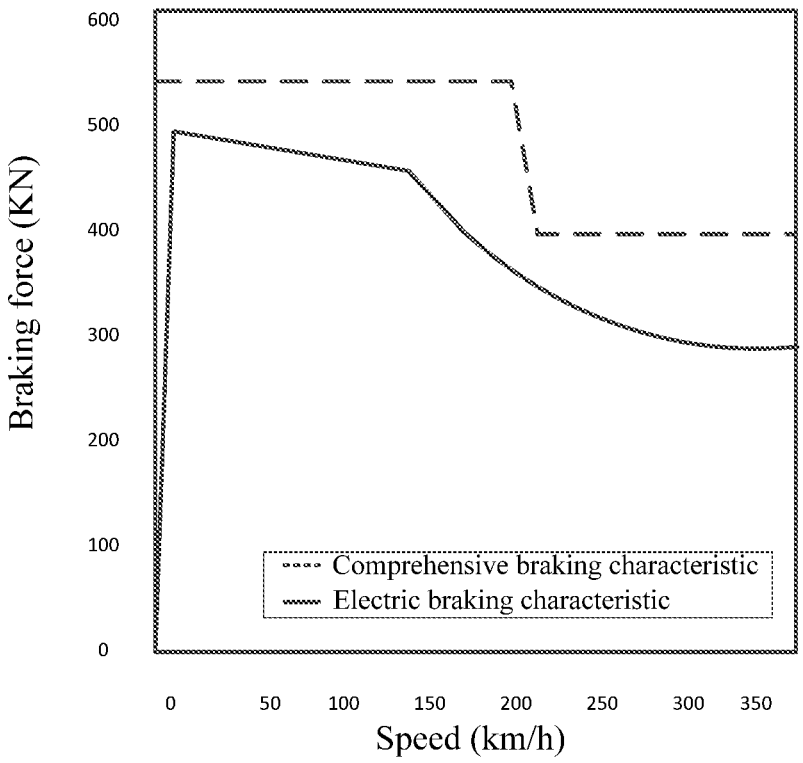
FIG. 3 shows the braking characteristic of comprehensive braking and electric braking.

As shown in FIG. 3, the maximum braking force of the train mainly includes two parts: an electric braking force and an air braking force. When the electric braking force is insufficient, the air braking force is activated to make up for the electric braking force.

The min-time speed profile is calculated according to the above rules. A single-step calculation is expressed as:

$$v_{i+1}^2 - v_i^2 = 2a_i\Delta x$$

where $v_{i+1}$ denotes the train's speed at the (i+1)-th point, $v_i$ denotes the train's speed at the i-th point, $a_i$ denotes the train's acceleration at the i-th point, and $\Delta x$ denotes the distance step size.

S33: Determine whether there is a surplus time between the minimum running time and the given train running time: If not, the min-time speed profile is taken as the energy-efficient optimized speed profile of the train in the normal state, and if yes, proceed to step S34.

In practical applications, it is determined whether there is a surplus time between the minimum running time and the given running time. That is, it is determined whether the minimum running time $T_{min}$ is less than the given running time $T_{give}$. If the given running time is less than the minimum running time, that is $T_{min} > T_{give}$, there is a surplus time for the optimization of the energy-efficient speed profile, and the minimum running speed profile is taken as the energy-efficient optimized speed profile of the train in the normal state. If not, the energy-efficient optimization calculation is performed according to the surplus time.

S34: Perform energy-efficient optimization according to the data of the min-time speed profile and the surplus time to acquire an optimized speed profile as the energy-efficient optimized speed profile of the train in the normal state, where an objective function of the optimized speed profile is:

$$\min J = \int_{x_0}^{x_f} F_t(v) - \alpha F_d(v)\,dx$$

where min J denotes a value of the objective function for minimum energy consumption of the train, $x_0$ and $x_f$ denote a starting position and an ending position of a running section, $F_t(v)$ denotes a traction force on the train, $F_d(v)$ denotes an electric braking force on the train, and $\alpha$ denotes a regenerative braking energy utilization of the train.

In practical applications, in the embodiment of the present disclosure, first, a traction-braking force sequence of the min-time speed profile is extracted.

Second, the capacity gradient of the traction-braking force sequence is calculated.

$$\rho = \frac{\Delta E}{\Delta t}$$

where $\rho$ denotes an energy gradient, $\Delta E$ denotes an energy consumption change, and $\Delta t$ denotes a time change.

Third, according to a certain step size, time is allocated to the traction-braking sequence with the highest energy gradient, that is, the same time is allocated to reduce the energy consumption the most. Then, the energy gradient is recalculated until all time is allocated, thereby acquiring the optimized energy gradient.

$$T_{give}-T_{min}-\Sigma\Delta t=0;$$

where $T_{give}$ denotes the running time given by the timetable.

Finally, the optimized speed profile is acquired according to the optimized energy gradient, which is taken as the energy-efficient optimized speed profile of the train in the normal state.

S4: Acquire an energy-efficient optimized speed profile of the train in an abnormal state according to the basic data of the train in the current state.

Figure 4:
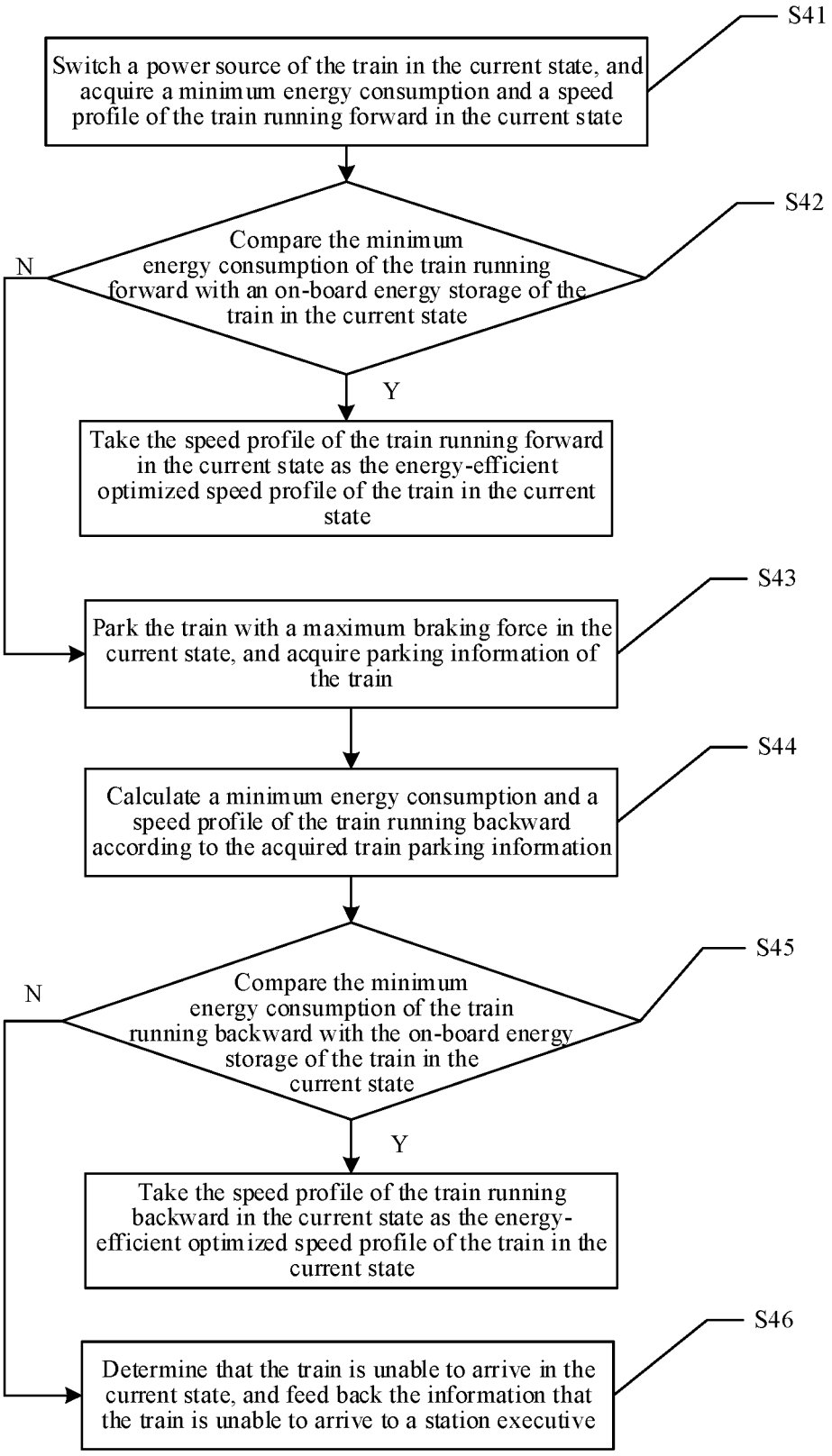
FIG. 4 is a flowchart of step S4 of the train driver assistance method according to the present disclosure.

As shown in FIG. 4, in this embodiment, step S4 specifically includes:

S41: Switch a power source of the train in the current state and acquire a minimum energy consumption and a speed profile of the train running forward to a scheduled station in the current state, where the minimum energy consumption is expressed as:

$$E_F=E_T+E_{AUX}$$

where $E_F$ denotes the minimum energy consumption of the train running forward; $E_T$ denotes the traction energy consumption of the train running forward, $$E_T = \sum_{i=0}^{n} f_i \cdot \Delta s;$$

n denotes the total number of steps for calculation of $E_T$; $f_i$ denotes a traction/braking force received by the train at the i-th step; $\Delta s$ denotes a distance calculated in a single step; $E_{AUX}$ denotes the auxiliary energy consumption of the train running forward, $E_{AUX}=P_{AUX}'\cdot T_F$; $P_{AUX}'$ denotes an auxiliary power of an auxiliary appliance; $T_F$ denotes a forward running time of the train, $$T_F = \sum_{i=0}^{n} \Delta t_i;$$

and $\Delta t_i$ denotes the running time of the train at the i-th step.

In this embodiment, in step S41, an objective function of the speed profile of the train running forward in the current state is expressed as:

$$\min J'=\int_{x_0}^{x_f} F_t(v)'-\alpha F_d(v)'dx+TP_{AUX}'$$

where min J' denotes the value of the objective function for the minimum energy consumption of the train running forward, $x_0$ and $x_f$ denote the starting position and the ending position of a running section, respectively, $F_t(v)'$ denotes the traction force on the train running forward, $F_d'$ denotes the electric braking force on the train running forward, $F_t(v)'$ denotes the regenerative braking energy utilization of the train, $\alpha$ denotes the regenerative braking energy utilization of the train, T denotes the total duration of the train in emergency running, and $P_{AUX}'$ denotes the auxiliary power of the train running forward.

In practical applications, in the embodiment of the present disclosure, the speed profile of the train running forward to the scheduled station in the current state is acquired as follows.

First, the min-time speed profile is calculated according to the basic data of the train in the current state, and the traction-braking force sequence is extracted.

Second, the capacity gradient of the traction-braking force sequence is calculated, $$\rho = \frac{\Delta E}{\Delta t}.$$

Third, the surplus time is allocated cyclically according to the energy gradient. According to the step size, time is allocated to the traction-braking sequence with the highest energy gradient, that is, the same time is allocated to reduce the energy consumption the most. Then, the energy gradient is recalculated until all time is allocated, that is, $T_{give}-T_{min}-\Sigma\Delta t=0$, thereby acquiring the optimized speed profile.

S42: Compare the minimum energy consumption of the train running forward with the on-board energy storage of the train in the current state: If the on-board energy storage is greater than the minimum energy consumption of the train running forward, take the speed profile of the train running forward to the scheduled station in the current state as the energy-efficient optimized speed profile of the train in the current state. If not, proceed to step S43.

In practical applications, the minimum energy consumption $E_F$ of the train running forward is compared with the on-board energy storage $E_{power}$ of the train in the current state. If the on-board energy storage of the train in the current state is greater than the minimum energy consumption of the train running backward, that is, $E_{power}>E_F$, the speed profile of the train running forward in the current state is taken as the energy-efficient optimized speed profile of the train in the current state. If not, the system proceeds to the following step.

S43: Park the train with a maximum braking force in the current state, acquire parking information of the train, and proceed to step S44.

S44: Calculate the minimum energy consumption and the speed profile of the train running backward according to the acquired train parking information, where the minimum energy consumption of the train running backward is expressed as:

$$E_B=E_T^*+E_{AUX}^*$$

where $E_B$ denotes the minimum energy consumption of the train running backward; $E_T^*$ denotes the traction energy consumption of the train running backward, $$E_T^* = \sum_{i=0}^{n} f_i \cdot \Delta s;$$

n denotes the total number of steps for calculation; $f_i$ denotes a traction/braking force received by the train at the i-th step; Δs denotes a distance calculated in a single step; $E_{AUX}^*$ denotes the auxiliary energy consumption of the train running backward, $E_{AUX}^*=P_{AUX}^* \cdot T_B$; $P_{AUX}^*$ denotes an auxiliary power of an auxiliary appliance; $T_B$ denotes a backward running time of the train, $$T_B = \sum_{i=0}^{n} \Delta t_i;$$

and $\Delta t_i$ denotes the running time of the train at the i-th step.

In this embodiment, in step S44, an objective function of the speed profile of the train running backward in the current state is expressed as:

$$\min J^* = \int_{x_0}^{x_f} F_t(v)^* - \alpha F_d(v)^* dx + TP_{AUX}^*$$

where min J* denotes a value of the objective function for the minimum energy consumption of the train running backward; $x_0$ and $x_f$ denote a starting position and an ending position of a running section, respectively; $F_t(v)^*$ denotes a traction force on the train running backward; $F_d(v)^*$ denotes an electric braking force on the train running backward; α denotes a regenerative braking energy utilization of the train; T denotes a total duration of the train in emergency running; and $P_{AUX}^*$ denotes an auxiliary power of the train running forward.

S45: Compare the minimum energy consumption of the train running backward with the on-board energy storage of the train in the current state: If the on-board energy storage $E_{power}^*$ of the train in the current state is greater than the minimum energy consumption $E_B$ of the train running backward, the speed profile of the train running backward in the current state is taken as the energy-efficient optimized speed profile of the train in the current state. If not, the system proceeds to step S46.

S46: Determine that the train cannot arrive in the current state and transmit the information that the train cannot arrive to a station executive.

Figure 5:
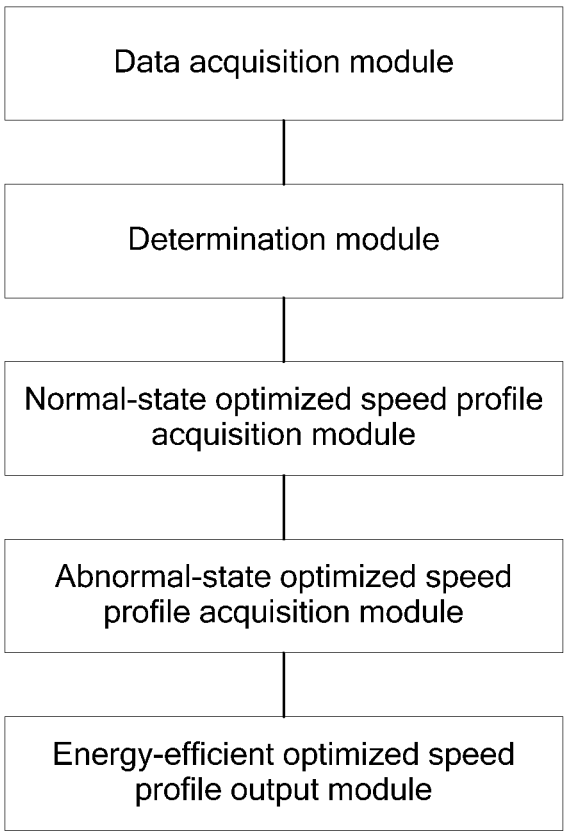
FIG. 5 is a structural diagram of a train driver assistance system according to the present disclosure.

As shown in FIG. 5, a train driver assistance system includes:

a data acquisition module configured to acquire basic data of a train undergoing a complex and severe condition;

a determination module configured to determine whether a traction power system is normal according to the basic data;

a normal-state optimized speed profile acquisition module configured to acquire an energy-efficient optimized speed profile of the train in a normal state according to the basic data of the train in a current state;

an abnormal-state optimized speed profile acquisition module configured to acquire an energy-efficient optimized speed profile of the train in an abnormal state according to the basic data of the train in the current state, and an energy-efficient optimized speed profile output module configured to output the acquired energy-efficient optimized speed profile.

The train driver assistance system provided by the embodiment of the present disclosure has the same beneficial effects as the above train driver assistance method.

Figure 6:
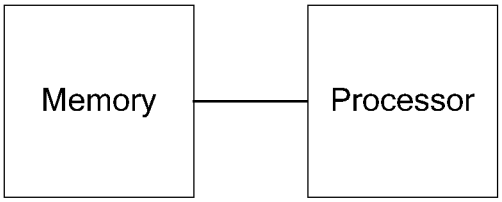
FIG. 6 is a structural diagram of a train driver assistance device according to the present disclosure.

As shown in FIG. 6, an embodiment of the present disclosure further provides a computer-readable storage medium. The computer-readable storage medium stores a computer program, which is executed by a processor to implement the above train driver assistance method.

The train driver assistance system provided by the embodiment of the present disclosure has the same beneficial effects as the above train driver assistance method.

The present disclosure is described with reference to the flowcharts and/or block diagrams of the method, device (system), and computer program product according to the embodiments of the present disclosure. It should be understood that computer program instructions may be used to implement each process and/or each block in the flowcharts and/or the block diagrams and a combination of a process and/or a block in the flowcharts and/or the block diagrams. These computer program instructions may be provided for a general-purpose computer, a dedicated computer, an embedded processor, or a processor of another programmable data processing device to generate a machine, such that the instructions executed by a computer or a processor of another programmable data processing device generate an apparatus for implementing a specific function in one or more processes in the flowcharts and/or in one or more blocks in the block diagrams.

These computer program instructions may also be stored in a computer-readable memory that can instruct a computer or another programmable data processing device to work in a specific manner, such that the instructions stored in the computer-readable memory generate an artifact that includes an instruction apparatus. The instruction apparatus implements a specific function in one or more processes in the flowcharts and/or in one or more blocks in the block diagrams.

These computer program instructions may also be loaded onto a computer or another programmable data processing device, such that a series of operations and steps are performed on the computer or another programmable device, thereby generating computer-implemented processing. Therefore, the instructions executed on the computer or another programmable device provide steps for implementing a specific function in one or more processes in the flowcharts and/or in one or more blocks in the block diagrams.

In this specification, specific embodiments are used to describe the principle and implementations of the present disclosure, and the description of the embodiments is only intended to help understand the method and core idea of the present disclosure. A person of ordinary skill in the art may make modifications to the specific implementations and the application scope based on the idea of the present disclosure. Therefore, the content of this specification shall not be construed as a limitation to the present disclosure.

Those of ordinary skill in the art will understand that the embodiments described herein are intended to help readers understand the principles of the present disclosure, and it should be understood that the protection scope of the present disclosure is not limited to such special statements and embodiments. Those of ordinary skill in the art may make other various specific modifications and combinations according to the technical teachings disclosed in the present disclosure without departing from the essence of the present disclosure, and such modifications and combinations still fall within the protection scope of the present disclosure.

What is claimed is:

1. A train driver assistance method comprising the following steps:

S1: acquiring basic data of a train under a complex and severe condition;

S2: determining whether a traction power system is normal according to the basic data; if the traction power system is normal, proceeding to step S3; and if the traction power system is not normal, proceeding to step S4;

S3: acquiring an energy-efficient optimized speed profile of the train in a normal state according to the basic data of the train in a current state; and S4: acquiring an energy-efficient optimized speed profile of the train in an abnormal state according to the basic data of the train in the current state.

2. The train driver assistance method according to claim 1, wherein step S2 specifically comprises:

determining whether the traction power system is normal according to a catenary voltage in running state information of the train; determining, if the catenary voltage is non-zero, that the traction power system is in a normal state, and proceeding to step S3; and determining, if the catenary voltage is zero, that the traction power system is in an abnormal state, and proceeding to step S4.

3. The train driver assistance method according to claim 1, wherein step S3 specifically comprises:

S31: giving a train running time;

S32: calculating the minimum running time and a min-time speed profile of the train according to the basic data of the train in the current state, wherein the minimum running time is calculated by:

$$T_{min} = \sum_{i=0}^{n} \Delta t_i$$

wherein $T_{min}$ denotes the minimum running time; n denotes a total number of steps for calculation; and $\Delta t_i$ denotes a running time of an i-th segment;

S33: determining whether there is a surplus time between the minimum running time and the train running time; if there is no surplus time between the minimum running time and the train running time, taking the min-time speed profile as the energy-efficient optimized speed profile of the train in the normal state; and if there is the surplus time between the minimum running time and the train running time, proceeding to step S34;

S34: performing energy-efficient optimization according to data of the min-time speed profile and the surplus time to acquire an optimized speed profile as the energy-efficient optimized speed profile of the train in the normal state, wherein an objective function of the optimized speed profile is:

$$\min J=\int_{x_0}^{x_f} F_t(v)-\alpha F_d(v)dx$$

wherein min J denotes a value of the objective function for a minimum energy consumption of the train; $x_0$ and $x_f$ denote a starting position and an ending position of a running section, respectively; $F_t(v)$ denotes a traction force on the train; $F_d(v)$ denotes an electric braking force on the train; and $\alpha$ denotes a regenerative braking energy utilization of the train.

4. The train driver assistance method according to claim 1, wherein step S4 specifically comprises:

S41: switching a power source of the train in the current state and acquiring a minimum energy consumption and a speed profile of the train running forward in the current state, wherein the minimum energy consumption of the train running forward is calculated by:

$$E_F=E_T+E_{AUX}$$

wherein $E_F$ denotes the minimum energy consumption of the train running forward; $E_T$ denotes a traction energy consumption of the train running forward; and $E_{AUX}$ denotes an auxiliary energy consumption of the train running forward;

S42: comparing the minimum energy consumption of the train running forward with an on-board energy storage of the train in the current state; taking the speed profile of the train running forward in the current state as the energy-efficient optimized speed profile of the train in the current state if the on-board energy storage is greater than the minimum energy consumption of the train running forward; and if the on-board energy storage is not greater than the minimum energy consumption of the train running forward, proceeding to step S43;

S43: parking the train with a maximum braking force in the current state, acquiring parking information of the train, and proceeding to step S44;

S44: calculating a minimum energy consumption and a speed profile of the train running backward according to the acquired train parking information, wherein the minimum energy consumption of the train running backward is expressed as:

$$E_B=E_T^*+E_{AUX}^*$$

wherein $E_B$ denotes the minimum energy consumption of the train running backward; $E_T^*$ denotes a traction energy consumption of the train running backward; and $E_{AUX}^*$ denotes an auxiliary energy consumption of the train running backward;

S45: comparing the minimum energy consumption of the train running backward with the on-board energy storage of the train in the current state; taking the speed profile of the train running backward in the current state as the energy-efficient optimized speed profile of the train in the current state if the on-board energy storage of the train in the current state is greater than the minimum energy consumption of the train running backward; and if the on-board energy storage of the train in the current state is not greater than the minimum energy consumption of the train running backward, proceeding to step S46;

S46: determining that the train is unable to arrive in the current state, and sending the information that the train is unable to arrive to a station executive.

5. The train driver assistance method according to claim 4, wherein in step S41, an objective function of the speed profile of the train running forward in the current state is expressed as:

$$\min J'=\int_{x_0}^{x_f} F_t(v)'-\alpha F_d(v)'dx+TP_{AUX}'$$

wherein min J' denotes a value of the objective function for the minimum energy consumption of the train running forward; $x_0$ and $x_f$ denote a starting position and an ending position of a running section, respectively; $F_t(v)'$ denotes a traction force on the train running forward; $F_d(v)'$ denotes an electric braking force on the train running forward; $F_t(v)'$ denotes a regenerative braking energy utilization of the train; a denotes a regenerative braking energy utilization of the train; T denotes a total duration of the train in emergency running; and $P_{AUX}'$ denotes an auxiliary power of the train running forward.

6. The train driver assistance method according to claim 4, wherein in step S44, an objective function of the speed profile of the train running backward in the current state is expressed as:

$$\min J^* = \int_{x_0}^{x_f} F_t(v)^* - \alpha F_d(v)^* dx + TP_{AUX}^*$$

wherein min J* denotes a value of the objective function for the minimum energy consumption of the train running backward; $x_0$ and $x_f$ denote a starting position and an ending position of a running section, respectively; $F_t(v)^*$ denotes a traction force on the train running backward; $F_d(v)^*$ denotes an electric braking force on the train running backward; α denotes a regenerative braking energy utilization of the train; T denotes a total duration of the train in emergency running; and $P_{AUX}^*$ denotes an auxiliary power of the train running forward.

7. A train driver assistance device comprising:

a memory configured to store a computer program; and a processor configured to execute the computer program to implement the train driver assistance method according to claim 1.

8. The train driver assistance device according to claim 7, wherein step S2 of the train driver assistance method specifically comprises:

determining whether the traction power system is normal according to a catenary voltage in running state information of the train; determining, if the catenary voltage is non-zero, that the traction power system is in a normal state, and proceeding to step S3; and determining, if the catenary voltage is zero, that the traction power system is in an abnormal state, and proceeding to step S4.

9. The train driver assistance device according to claim 7, wherein step S3 of the train driver assistance method specifically comprises:

S31: giving a train running time;

S32: calculating the minimum running time and a min-time speed profile of the train according to the basic data of the train in the current state, wherein the minimum running time is calculated by:

$$T_{min} = \sum_{i=0}^{n} \Delta t_i$$

wherein $T_{min}$ denotes the minimum running time; n denotes a total number of steps for calculation; and $\Delta t_i$ denotes a running time of an i-th segment;

S33: determining whether there is a surplus time between the minimum running time and the train running time; if there is no surplus time between the minimum running time and the train running time, taking the min-time speed profile as the energy-efficient optimized speed profile of the train in the normal state; and if there is the surplus time between the minimum running time and the train running time, proceeding to step S34;

S34: performing energy-efficient optimization according to data of the min-time speed profile and the surplus time to acquire an optimized speed profile as the energy-efficient optimized speed profile of the train in the normal state, wherein an objective function of the optimized speed profile is:

$$\min J = \int_{x_0}^{x_f} F_t(v) - \alpha F_d(v) dx$$

wherein min J denotes a value of the objective function for a minimum energy consumption of the train; $x_0$ and $x_f$ denote a starting position and an ending position of a running section, respectively; $F_t(v)$ denotes a traction force on the train; $F_d(v)$ denotes an electric braking force on the train; and α denotes a regenerative braking energy utilization of the train.

10. The train driver assistance device according to claim 7, wherein step S4 of the train driver assistance method specifically comprises:

S41: switching a power source of the train in the current state and acquiring a minimum energy consumption and a speed profile of the train running forward in the current state, wherein the minimum energy consumption of the train running forward is calculated by:

$$E_F = E_T + E_{AUX}$$

wherein $E_F$ denotes the minimum energy consumption of the train running forward; $E_T$ denotes a traction energy consumption of the train running forward; and $E_{AUX}$ denotes an auxiliary energy consumption of the train running forward;

S42: comparing the minimum energy consumption of the train running forward with an on-board energy storage of the train in the current state; taking the speed profile of the train running forward in the current state as the energy-efficient optimized speed profile of the train in the current state if the on-board energy storage is greater than the minimum energy consumption of the train running forward; and if the on-board energy storage is not greater than the minimum energy consumption of the train running forward, proceeding to step S43;

S43: parking the train with a maximum braking force in the current state, acquiring parking information of the train, and proceeding to step S44;

S44: calculating a minimum energy consumption and a speed profile of the train running backward according to the acquired train parking information, wherein the minimum energy consumption of the train running backward is expressed as:

$$E_B = E_T^* + E_{AUX}^*$$

wherein $E_B$ denotes the minimum energy consumption of the train running backward; $E_T^*$ denotes a traction energy consumption of the train running backward; and $E_{AUX}^*$ denotes an auxiliary energy consumption of the train running backward;

S45: comparing the minimum energy consumption of the train running backward with the on-board energy storage of the train in the current state; taking the speed profile of the train running backward in the current state as the energy-efficient optimized speed profile of the train in the current state if the on-board energy storage of the train in the current state is greater than the minimum energy consumption of the train running backward; and if the on-board energy storage of the train in the current state is not greater than the minimum energy consumption of the train running backward, proceeding to step S46;

S46: determining that the train is unable to arrive in the current state, and sending the information that the train is unable to arrive to a station executive.

11. A computer-readable storage medium, storing a computer program, wherein the computer program is executed by a processor to implement the train driver assistance method according to claim 1.

12. The computer-readable storage medium according to claim 11, wherein step S2 of the train driver assistance method specifically comprises:

determining whether the traction power system is normal according to a catenary voltage in running state information of the train; determining, if the catenary voltage is non-zero, that the traction power system is in a normal state, and proceeding to step S3; and determining, if the catenary voltage is zero, that the traction power system is in an abnormal state, and proceeding to step S4.

13. The computer-readable storage medium according to claim 11, wherein step S3 of the train driver assistance method specifically comprises:

S31: giving a train running time;

S32: calculating a minimum running time and a min-time speed profile of the train according to the basic data of the train in the current state, wherein the minimum running time is calculated by:

$$T_{min} = \sum_{i=0}^{n} \Delta t_i$$

wherein $T_{min}$ denotes the minimum running time; n denotes a total number of steps for calculation; and $\Delta t_i$ denotes a running time of an i-th segment;

S33: determining whether there is a surplus time between the minimum running time and the train running time; if there is not the surplus time between the minimum running time and the train running time, taking the min-time speed profile as the energy-efficient optimized speed profile of the train in the normal state; and if there is the surplus time between the minimum running time and the train running time, proceeding to step S34;

S34: performing energy-efficient optimization according to data of the min-time speed profile and the surplus time to acquire an optimized speed profile as the energy-efficient optimized speed profile of the train in the normal state, wherein an objective function of the optimized speed profile is:

$$\min J=\int_{x_0}^{x_f} F_t(v)-\alpha F_d(v)dx$$

wherein min J denotes a value of the objective function for a minimum energy consumption of the train; $x_0$ and $x_f$ denote a starting position and an ending position of a running section, respectively; $F_t(v)$ denotes a traction force on the train; $F_d(v)$ denotes an electric braking force on the train; and $\alpha$ denotes a regenerative braking energy utilization of the train.

14. The computer-readable storage medium according to claim 11, wherein step S4 of the train driver assistance method specifically comprises:

S41: switching a power source of the train in the current state and acquiring a minimum energy consumption and a speed profile of the train running forward in the current state, wherein the minimum energy consumption of the train running forward is calculated by:

$$E_F=E_T+E_{AUX}$$

wherein $E_F$ denotes the minimum energy consumption of the train running forward; $E_T$ denotes a traction energy consumption of the train running forward; and $E_{AUX}$ denotes an auxiliary energy consumption of the train running forward;

S42: comparing the minimum energy consumption of the train running forward with an on-board energy storage of the train in the current state; taking the speed profile of the train running forward in the current state as the energy-efficient optimized speed profile of the train in the current state if the on-board energy storage is greater than the minimum energy consumption of the train running forward; and if the on-board energy storage is not greater than the minimum energy consumption of the train running forward, proceeding to step S43;

S43: parking the train with a maximum braking force in the current state, acquiring parking information of the train, and proceeding to step S44;

S44: calculating a minimum energy consumption and a speed profile of the train running backward according to the acquired train parking information, wherein the minimum energy consumption of the train running backward is expressed as:

$$E_B=E_T^*+E_{AUX}^*$$

wherein $E_B$ denotes the minimum energy consumption of the train running backward; $E_T^*$ denotes a traction energy consumption of the train running backward; and $E_{AUX}^*$ denotes an auxiliary energy consumption of the train running backward;

S45: comparing the minimum energy consumption of the train running backward with the on-board energy storage of the train in the current state; taking the speed profile of the train running backward in the current state as the energy-efficient optimized speed profile of the train in the current state if the on-board energy storage of the train in the current state is greater than the minimum energy consumption of the train running backward; and if the on-board energy storage of the train in the current state is not greater than the minimum energy consumption of the train running backward, proceeding to step S46;

S46: determining that the train is unable to arrive in the current state, and sending the information that the train is unable to arrive to a station executive.

15. A train driver assistance system, comprising:

a data acquisition module configured to acquire basic data of a train under a complex and severe condition;

a determination module configured to determine whether a traction power system is normal according to the basic data;

a normal-state optimized speed profile acquisition module configured to acquire an energy-efficient optimized speed profile of the train in a normal state according to the basic data of the train in a current state;

an abnormal-state optimized speed profile acquisition module configured to acquire an energy-efficient optimized speed profile of the train in an abnormal state according to the basic data of the train in the current state; and an energy-efficient optimized speed profile output module configured to output the acquired energy-efficient optimized speed profile.

* * * * *